US005515779A

United States Patent [19]

Danby

[11] Patent Number: 5,515,779

[45] Date of Patent: May 14, 1996

[54] METHOD FOR PRODUCING AND PRINTING ON A PIECE OF PAPER

[75] Inventor: Roger Danby, Arnprior, Canada

[73] Assignee: Huyck Licensco, Inc., Wilmington, Del.

[21] Appl. No.: 322,264

[22] Filed: Oct. 13, 1994

[51] Int. Cl.[6] ..... B41M 1/12; B41M 1/14; D21F 11/00

[52] U.S. Cl. ..... 101/129; 101/211; 162/903

[58] Field of Search ..... 101/129, 170, 101/211, 401.1, 483; 139/383 A; 162/900, 902, 903, 904

[56] References Cited

U.S. PATENT DOCUMENTS

| | | | |
|---|---|---|---|
| 3,221,646 | 12/1965 | Hardy et al. | 101/115 |
| 3,858,623 | 1/1975 | Lefkowitz | 139/425 A |
| 3,880,076 | 4/1975 | Black et al. | 101/115 |
| 4,063,998 | 12/1977 | Henke | 162/348 |
| 4,093,512 | 6/1978 | Fleischer | 162/348 |
| 4,147,103 | 4/1979 | Newton et al. | 101/115 |
| 4,157,276 | 6/1979 | Wandel et al. | 162/348 |
| 4,161,195 | 7/1979 | Khan | 139/383 A |
| 4,239,065 | 12/1980 | Trokhan | 139/383 A |
| 4,470,434 | 9/1984 | Vuorio | 139/425 A |
| 4,564,051 | 1/1986 | Odenthal | 139/425 A |
| 4,636,426 | 1/1987 | Fleischer | 428/224 |
| 4,669,378 | 6/1987 | Lee | 101/115 |
| 4,671,174 | 6/1987 | Tartaglia et al. | 101/115 |
| 4,909,284 | 3/1990 | Kositzke | 139/383 A |
| 4,934,414 | 6/1990 | Borel | 139/383 A |
| 4,945,952 | 8/1990 | Vöhringer | 139/383 A |
| 4,967,805 | 11/1990 | Chiu et al. | 139/383 A |
| 4,989,648 | 2/1991 | Tate et al. | 162/903 |
| 4,995,429 | 2/1991 | Kositzke | 139/383 A |
| 5,101,866 | 4/1992 | Quigley | 139/383 A |
| 5,252,838 | 10/1993 | Timblin | 250/561 |

*Primary Examiner*—Stephen Funk
*Attorney, Agent, or Firm*—Lorusso & Loud

[57] ABSTRACT

A method for producing a printed piece of paper wherein the paper is formed by forming fabric having knuckles disposed thereon. Color printing screens are provided having diagonals for depositing ink arranged at angles of typically 45° or more. The printing screens are applied to the paper after ensuring that the angles of the diagonals in the printing screens are different from angles of areas of high and low density in the paper formed by the forming fabric knuckles when the printing screens overlie the piece of paper, whereby to provide more uniform print on the piece of paper.

5 Claims, 4 Drawing Sheets

METHOD FOR PRODUCING AND PRINTING ON A PIECE OF PAPER

BACKGROUND OF THE INVENTION (1) Field of the Invention

This invention relates to paper making and paper printing, and is directed more particularly to a paper forming fabric for making paper better suited for receiving print thereon, and to a method for producing a printed piece of paper utilizing the paper forming fabric.

(2) Description of the Prior Art

It is known that the quality of print on paper is directly related to the uniformity of the density of the sheet of paper on which the printing ink is deposited. High density paper results in low ink penetration and high gloss of the printed product, while low density paper results in greater penetration and low gloss in the appearance of the print.

The weave pattern of paper forming fabrics results in "knuckles" wherein yarns cross each other and provide raised yarn portions in the surface of the fabric. Such "knuckles" are disposed at an angle to the width of the forming fabric, the angle often referred to as the "twill angle" of the fabric.

Such woven structures create micro density differences in a sheet of paper formed thereon, with relatively low density occurring over the knuckles of the fabric and relatively high density occurring over the holes bounded by the yarns of the fabric. Such low and high density areas, alternating along a line corresponding to the fabric twill angle, produce areas of different print quality along the line because of the different degrees of ink penetration into the sheet.

In color printing anything other than solid colors, that is, in printing images of people, places or things, using shading, or the like, printers use printing screens, with each screen laying down one of four basic colors and having micro droplets of ink, or "dots" applied to the paper at an angle different from the angle at which the micro droplets of the remaining screens are applied to the paper. The standard angles at which the basic color ink droplets are applied are 45° for black, 75° for magenta, 90° for yellow, and 105° for cyan. Each color is laid down at a different pre-determined angle in order to prevent "moiré" which is a term given to describe overlay, or overlapping of colors.

The printing screens themselves typically are of copper and are acid-etched to provide millions of micro surfaces for retention of the aforesaid ink droplets. The droplets are arranged in diagonal rows at the aforesaid prescribed angles for basic colors. Such angled rows of droplets are referred to as "diagonals". Study has revealed that when the fabric twill angle produces a line of alternating high and low density areas in paper, and the diagonals of one or more of the printing screens coincide with that line on the paper, the coincidence of such density difference in the paper and the diagonals of the printing screens can create an adverse variation in the uniformity of the print quality due to a moire' effect between the twill lines of the forming fabric and the diagonals of any of the basic print screens.

It therefore is beneficial to have the diagonals of the print screens not coincide with the line of high and low density areas in the paper generated by the forming fabric twill angle.

SUMMARY OF THE INVENTION

It is therefore an object of the invention to provide a paper forming fabric having a twill angle less likely to phase in with the diagonals of printing screens.

A further object of the invention is to provide in combination printing screens having selected diagonals thereon and a paper forming fabric having twill angles thereon at least in part different from the diagonal angles.

A still further object of the invention is to provide a method for producing a printed piece of paper wherein the twill angle of the paper forming fabric is less likely to phase in with the diagonals of the printing screens.

With the above and other objects in view, as will hereinafter appear, a feature of the present invention is the provision of a paper forming fabric comprising a sheet side layer having first yarns extending in a first direction and second yarns extending in a second direction normal to the first direction. The first and second yarns are interwoven to form knuckles in the layer. The knuckles extend from a line defining the width of the forming fabric at an angle of less than 45°.

In accordance with a further feature of the invention, there is provided a paper forming fabric comprising a sheet side layer having first yarns extending in a first direction and second yarns extending in a second direction normal to the first direction. A first of the first yarns passes over a first of the second yarns and alternately under and over a remainder of the second yarns to form knuckles. One or more of the first yarns neighboring the first of the first yarns passes under the first of the second yarns and alternately over and under the remainder of the second yarns to form additional knuckles. The knuckles extend from a line defining a width of the forming fabric at an angle of less than 45°.

In accordance with a still further feature of the invention, there is provided a paper forming fabric comprising a sheet side layer having first yarns extending in a first direction and second yarns extending in a second direction normal to the first direction. A first of the first yarns passes over a first of the second yarns and alternately under and over one or more of a remainder of the second yarns to form knuckles. One or more of the first yarns neighboring the first of the first yarns passes under the first of the second yarns and over the second yarns under which the first of the first yarns passes and under the second yarns over which the first of the first yarns passes to form additional knuckles. The knuckles extend from a line defining the width of the forming fabric at an angle of less than 45°.

In accordance with a further feature of the invention, there is provided, in combination, printing screen means for depositing ink of up to four basic colors on a piece of paper, and a paper forming fabric for making the paper, the combination including up to four printing screens. Each of the printing screens is adapted to deposit ink on the paper, each of the screens being adapted to retain microdroplets of ink of one of the colors and to effect the deposit of the ink on the paper, the microdroplets being arranged in rows extending in lines on a surface of each of the screens, the rows extending at selected angles from a base of the screen. The combination further includes a paper forming fabric for forming the paper. The fabric is provided with knuckles arranged in lines at angles to a line defining the width of the fabric, the fabric line angles being at least in part different from alternating areas of high and low density of the paper formed along the fabric angles.

In accordance with a still further feature of the invention, there is provided a method for producing a printed piece of paper, the method including the steps of forming a papermakers' paper-forming fabric having on the sheet side thereof a selected twill angle of less than 45°, forming paper using the fabric, the paper thereby having alternating areas of high and low density along a line corresponding to the fabric twill angle. The method further comprises providing up to four basic color printing screens, each having a selected diagonal of 45° or more, and applying the printing screens to a piece of the paper, each of the printing screens carrying one of the basic colors with no two screens carrying the same color. The diagonal angles of the printing screens are different from the lines of alternating areas of high and low density on the piece of paper, when the printing screens overlie the piece of paper, to produce a more uniform print on the piece of paper.

The above and other features of the invention, including various novel details of construction and combinations of parts and method steps, will now be more particularly described with reference to the accompanying drawings and pointed out in the claims. It will be understood that the particular fabric and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
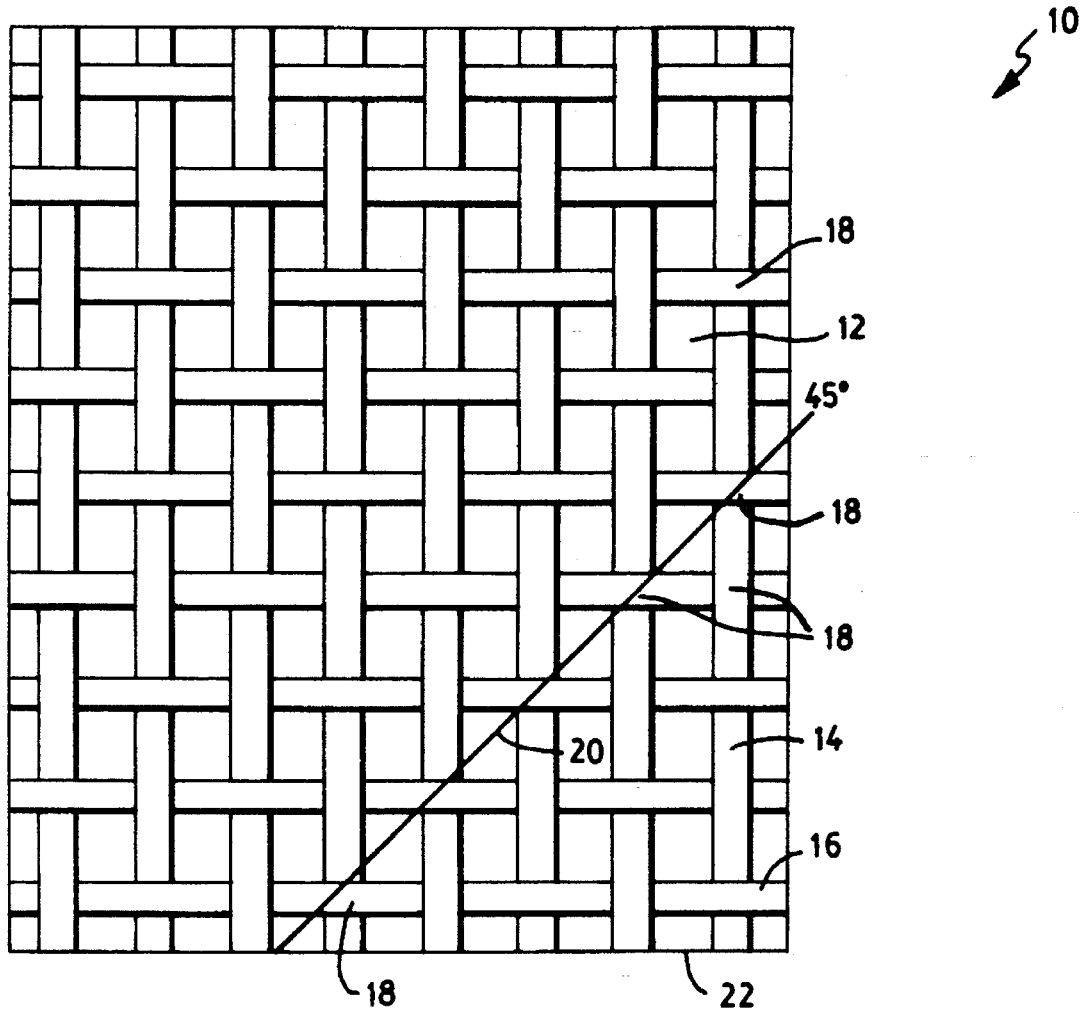
FIG. 1 PRIOR ART
FIG. 1 is a plan view of a sheet side of a prior art paper forming fabric of the triple layer type.

Referring to FIG. 1, it will be seen that in a typical papermakers' paper forming fabric 10, the paper forming side thereof 12 includes woven machine direction yarns 14 and cross machine direction yarns 16 intersecting and woven over and under each other in alternating fashion to form knuckles 18. The knuckles 18 often are disposed in a straight line 20 extending from a line 22 defining the width, or cross machine extent, of the fabric. Such fabrics 10 commonly have such lines 20 extending at an angle, referred to as the "twill angle" of 45° or more to the width of the fabric, as illustrated in FIG. 1.

When the fabric 10 is used in paper making operations, the paper made thereon includes lines of alternating relatively high and low density areas, the lines of such areas corresponding to the twill angles of the fabric. Thus, using the fabric 10 illustrated in FIG. 1, paper produced thereon has therein a line of alternating high and low densities extending at an angle of 45° to a base edge of the paper.

Figure 2:
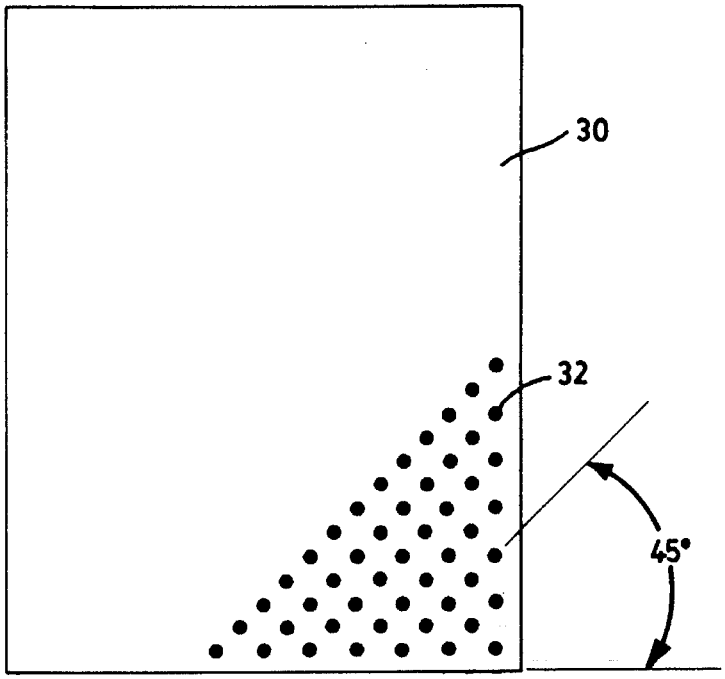
PRIOR ART FIG. 2
FIG. 2 is a plan view of a prior art printing screen, with diagonals therein illustrated diagrammatically.
Figure 3:
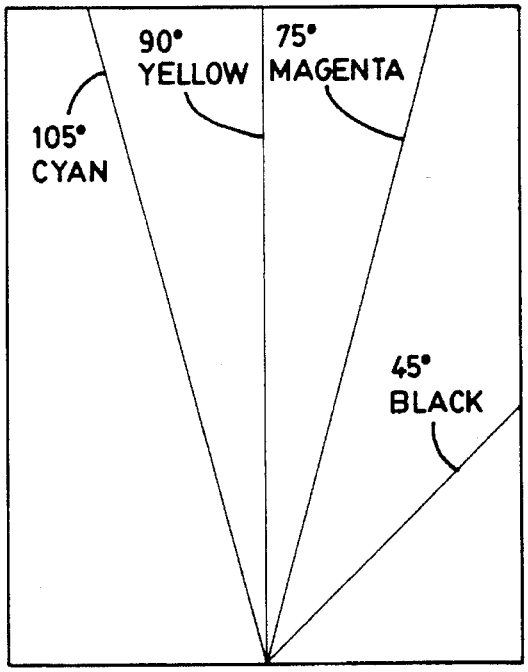
PRIOR ART FIG. 3
FIG. 3 is a depiction of diagonal angles, known in the art, on which printing inks are applied to paper.

Referring to FIG. 2, there is diagrammatically illustrated a printing screen 30 for the basic color black. The printing screen 30 is acid etched to provide millions of micro areas 32 adapted each to retain a micro droplet, or dot, of printers ink. In screens for printing of the color black the etched micro areas extend in lines disposed at 45° to a base edge of the paper. In FIG. 3, there are illustrated the angles at which the etched lines of micro areas are disposed for the remaining basic colors, namely, 75° for magenta, 90° for yellow, and 105° for cyan.

Figure 4:
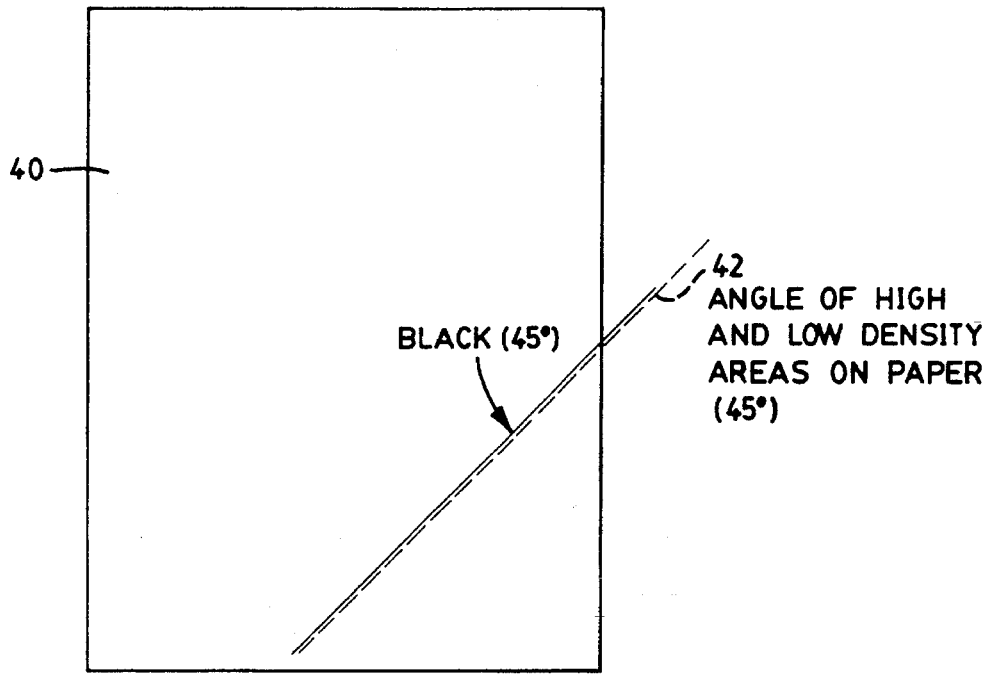
PRIOR ART FIG. 4
FIG. 4 is a composite plan view of a prior art sheet of paper with lines illustrating an angle at which high and low density areas often occur in the paper and an angle at which prior art screen diagonals impinge upon the paper in laying down ink.

In FIG. 4, there is illustrated the common situation in which a piece of paper 40 has therein a line 42 of high and low density areas corresponding to the 45° twill angle of the fabric on which the paper was formed. Black print is laid down on the paper 40 at the same 45° angle, resulting in the diagonals of ink coinciding with the lines of high and low paper density, resulting in alternating areas of print quality.

Figure 5:
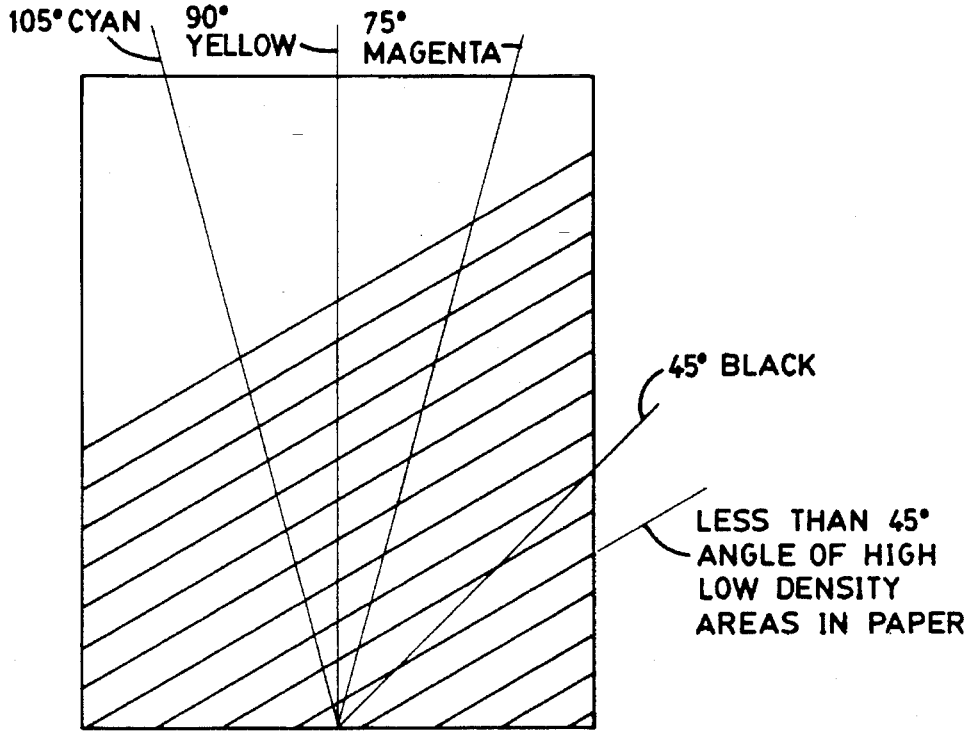
FIG. 5 is similar to FIG. 4, but illustrating the various angles in accordance with the present invention.
Figure 6:
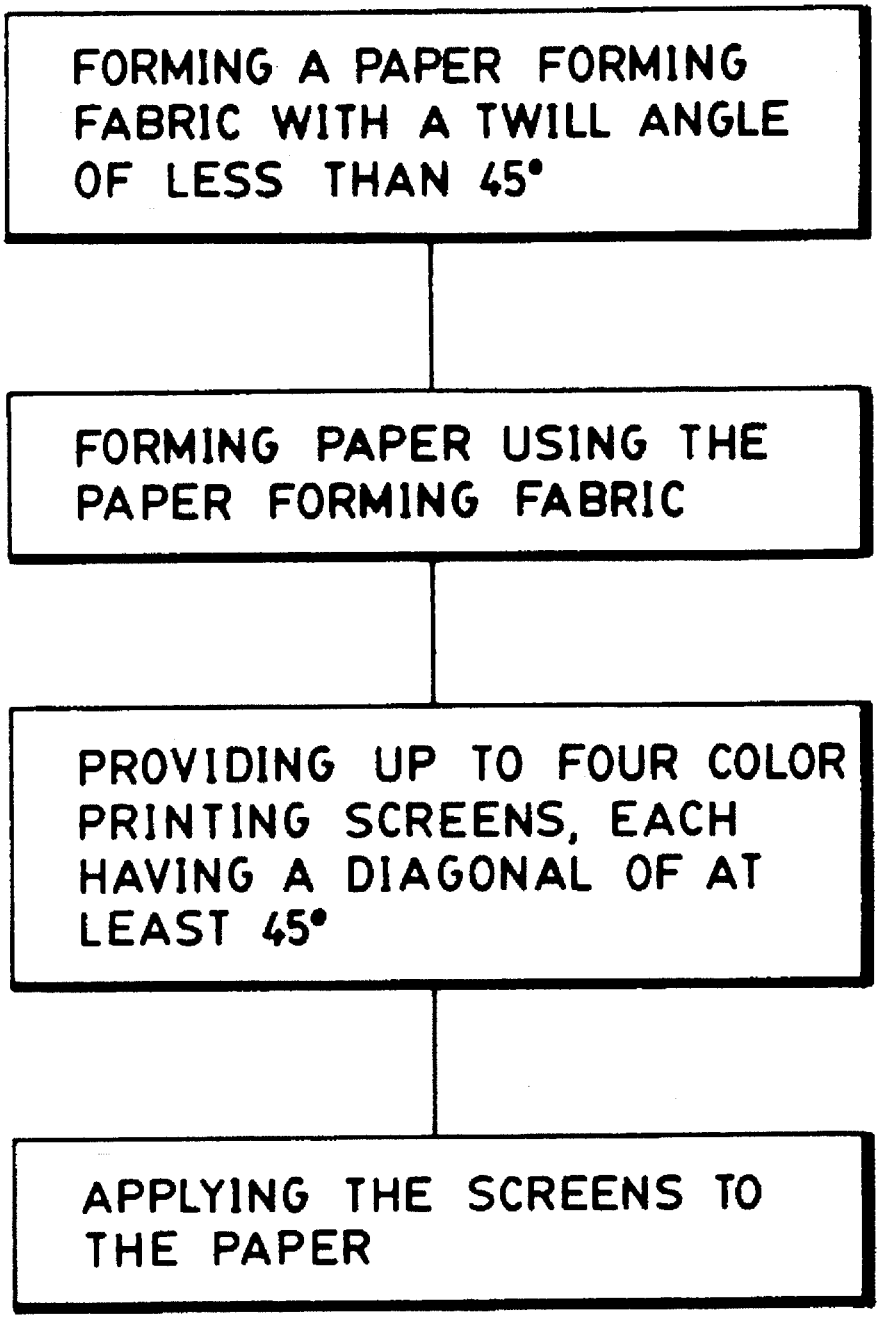
FIG. 6 is a block diagram illustrative of the inventive method.

In FIG. 5, there is illustrated diagrammatically paper formed on a fabric having a twill angle of less than 45° (30° illustrated). The 30° twill angle line avoids tracking the diagonals of the printing screens.

It is recognized that in a particular fabric weave pattern, twill angles occur at other than the basic twill angle. For example, in the weave shown in FIG. 1, the twills are aligned not only at 45° but also at 90°. Providing a twill angle 20 in the forming fabric 10 of less than 45° will avoid the black color diagonal, but not necessarily the other basic color diagonals. For maximum benefit, it is preferred that the twill angles of the forming fabric not coincide with any diagonals of the basic colors. However, avoidance of any of the basic color diagonals results in an improvement in the quality of print.

In carrying out the method herein, an operator first forms a paper forming fabric with a twill angle of less than 45°. Using the fabric, the operator forms paper. Up to four color printing screens are provided, each having a diagonal of at least 45°, and the color screens are applied to the paper.

There is thus provided means and method for effecting color printing of paper wherein the diagonals of the printing screens avoid coincidence with lines of high and low density in the paper, thereby providing a higher quality printed piece of paper.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A method for producing a printed piece of paper, said method comprising the steps of:

forming a papermakers' paper-forming fabric having on a sheet side thereof a selected twill angle;

forming paper using said fabric, said paper thereby having alternating areas of high and low density along lines corresponding to said selected twill angle;

providing up to four color printing screens, each of said screens having a selected screen angle;

applying said printing screens to a piece of said paper, each of said printing screens carrying a basic color, with no two of said screens carrying the same basic color; and ensuring that said selected screen angles of said printing screens are different from said lines of alternating high and low density areas on said piece of paper when said printing screens overlie said piece of paper, whereby to produce a more uniform print on said piece of paper.

2. A method according to claim 1 wherein said selected twill angle is between 0° and 45°.

3. A method of producing a printed piece of paper comprising:

forming a papermakers' paper-forming fabric having on a sheet side thereof a selected twill angle;

forming paper using said fabric, said paper thereby having alternating areas of high and low density along lines corresponding to said selected twill angle;

providing four basic color printing screens, respectively having screen angles of 45°, 75°, 90°, and 105°;

applying said printing screens to a piece of said paper, each of said printing screens carrying one of the basic colors black, magenta, yellow, and cyan, with no two screens carrying the same color; and ensuring that each of said screen angles of said printing screens is different from said lines of alternating areas of high and low density on said piece of paper, such that said screen angles fail to coincide with said line on said paper, thereby providing a more uniform print on said piece of paper.

4. A method according to claim 3 wherein said selected twill angle is between 0° and 45°.

5. A method of producing a printed piece of paper comprising:

providing up to four color printing screens, each of said screens having a selected screen angle;

providing a piece of paper having alternating areas of high and low density along lines corresponding to a twill angle in a paper-forming fabric used to make said piece of paper;

ensuring that said lines of alternating areas of high and low density do not coincide with said selected screen angles; and applying said printing screens to said piece of said paper, each of said printing screens carrying a basic color, thereby providing a more uniform print on said piece of paper.

* * * * *